US007595601B2

(12) United States Patent
Kushida

(10) Patent No.: US 7,595,601 B2
(45) Date of Patent: Sep. 29, 2009

(54) ELECTRIC BOLT/NUT FASTENER

(75) Inventor: Toshihiko Kushida, Osaka (JP)

(73) Assignee: Maeda Metal Industries, Ltd., Osaka (JP)

( * ) Notice: Subject to any disclaimer, the term of this patent is extended or adjusted under 35 U.S.C. 154(b) by 376 days.

(21) Appl. No.: 11/733,798

(22) Filed: Apr. 11, 2007

(65) Prior Publication Data

US 2008/0251268 A1 Oct. 16, 2008

(30) Foreign Application Priority Data

Apr. 12, 2006 (JP) ..... 2006-109286

(51) Int. Cl.
*B25B 21/00* (2006.01)
*B25B 23/151* (2006.01)

(52) U.S. Cl. ..... 318/434; 318/431; 388/937

(58) Field of Classification Search ..... 318/430–434; 388/937

See application file for complete search history.

(56) References Cited

U.S. PATENT DOCUMENTS

| | | | | |
|---|---|---|---|---|
| 4,959,797 | A * | 9/1990 | McIntosh | 700/275 |
| 5,105,130 | A * | 4/1992 | Barker et al. | 318/268 |
| 5,440,215 | A * | 8/1995 | Gilmore | 318/432 |
| 5,490,439 | A * | 2/1996 | Matsumura et al. | 81/469 |
| 2007/0103104 | A1 * | 5/2007 | May | 318/432 |

FOREIGN PATENT DOCUMENTS

JP HEI.9-314478 A 12/1997

* cited by examiner

*Primary Examiner*—Bentsu Ro
(74) *Attorney, Agent, or Firm*—Kirk D. Houser; Eckert Seamans Cherin & Mellott, LLC

(57) ABSTRACT

An abrupt fall in a current value immediately after an abrupt rise at the time when an starting switch is turned ON is detected, when the current value rises due to starting of nut fastening and then the current value abruptly falls, it is determined that an inward flange of a washer is sheared, and when the current value reaches a value corresponding to a primary fastening torque, the motor is stopped.

8 Claims, 9 Drawing Sheets

ELECTRIC BOLT/NUT FASTENER

BACKGROUND OF THE INVENTION

1. Field of the Invention

The present invention relates to an electric fastener which fastens bolts to a member to be fastened such as steel frames.

2. Description of the Related Art

FIGS. 6 to 9 illustrate the steps of fastening a plurality of steel frames 3 with a one-side bolt 2 having a shear washer. FIG. 11 illustrates a waveform of a value of an electric current flowing in a driving motor 15 of an electric fastener 1 for fastening the one-side bolt 2 (hereinafter, simply "current value") at the time of the fastening steps.

In FIG. 6, a side from which the one-side bolt 2 is inserted into the steel frames 3 is designated by A and the opposite side is designated by B. As publicly known, the one-side bolt 2 can fasten a nut on the insertion side A differently from normal bolt and nut. That is to say, the bolt and nut can be fastened from one side.

As shown in FIG. 6, the one-side bolt 2 having shear washer is constituted such that a bolt head 22, a tube member for collar 27, a spacer tube 29 and a shear washer 25 are fitted into a shear bolt 21 in this order so as to be slidable in an axial direction, whereupon a nut 24 is screwed thereinto.

The shear bolt 21 has a shearing chip 23 at its front end. The shear washer 25 touches an end surface of the spacer tube 29, and has a flange 26 which is sheared by pressurizing the spacer tube 29 in the direction shown by an arrow C so as to project inwardly.

In the electric fastener 1, a casing 11 houses a planetary gear reduction mechanism 14 having one input shaft and two output shafts. An outer socket 12 and an inner socket 13 which concentrically protrude from the front end of the casing are connected to the two output shafts of the planetary gear reduction mechanism 14 so as to be capable of rotating in opposite directions. A motor 15 is connected to the input shaft of the planetary gear reduction mechanism 14 (for example, see Japanese Patent Application Laid-Open No. HEI09-314478).

As shown in FIG. 6, the one-side bolt 2 is inserted into holes 31, which are opened on a plurality of superposed steel frames 3 in advance, on the insertion side A, and the tube member for collar 27 is protruded from the opposite side B.

The inner socket 13 of the electric fastener 1 is fitted into a bolt chip 23, and the outer socket 12 is fitted into the nut 24. A trigger 16 of the electric fastener 1 is pulled so that a motor starting switch 47 is turned ON.

After the starting switch 47 is turned ON and the motor 15 is electrically connected, instantly the current value of the motor 15 abruptly rises as shown by "E" in FIG. 11, and immediately after that, the value abruptly falls as shown by "F". This is a so-called rush current phenomenon.

At this stage, a load is hardly applied to the motor 15, and the current value converges to a lower value.

As shown in FIG. 7, the bolt 21 is drawn to the side of the electric fastener by the rotation of the nut 24. An inward flange 26 of the washer 25 abuts against the end surface of the spacer tube 29 (hereinafter, this state is called "seating of the nut") in a state where no gap is present between the end surface of the tube member for collar 27 and the bolt head 22 and between the tube member for collar 27 and the spacer tube 29.

When the nut 24 is seated, a thrust force produced by the rotation of the nut is applied as an axis-direction compressing force to the tube member for collar 27 and the spacer tube 29. The spacer tube 29 fitted and restrained in the holes 31 of the steel frames 3 cannot be deformed. Therefore, the tube member for collar 27 positioned on the outside of the holes 31 is plastically deformed by the axis-direction compressing force so as to expand into a collar shape (see FIG. 7).

When the screw thrust force produced by the rotation of the nut 24 is applied, the spacer tube 29 pushes and shears the inward flange 26 of the shear washer 25 (see FIG. 8) (hereinafter, this state is called "shearing of the shear washer 25").

During the fastening operation, the inner socket 13 engaged with the bolt chip 23 is a reactive force receiver, and prevents the nut 24 and the bolt 21 from rotating together.

In FIG. 11, "G" indicates the current value at the time when the nut is seated, and "H" indicates the current value at the time when the shear washer 25 is sheared. It is found that the current value gradually increases from "G" to "H".

At the moment when the inward flange 26 is sheared, the current value abruptly falls and converges to a low value.

As shown in FIG. 8, the inward flange 26 is sheared and is allowed to go into the washer 25 of the spacer tube 29. As a result, a collar portion 28 of the tube member for collar 27 is seated in the steel frame 3.

The above steps are the fastening steps of the bolt and nut in order to form the collar portion 28 on the tube member for collar 27 and to seat the collar portion 28 in the steel frame 3, and thus the fastening force is not applied to the steel frames 3.

After the collar portion 28 is seated in the steel frame 3, the fastening to the steel frames 3 is started, and when the nut 24 is fastened up completely, the rotation of the outer socket 12 is stopped. The inner socket 13 rotates in a direction opposite to the outer socket 12 so as to shear the bolt chip 23.

When the bolt chip 23 is sheared, it is ensured that the one-side bolt 2 is fastened by a predetermined torque.

In FIG. 11, "J" indicates the current value at the time of starting the fastening to the steel frames and "O" indicates the current value at the time of shearing the bolt chip 23. Since the load to the motor 15 instantly falls at the moment when the bolt chip 23 is sheared, the current value abruptly falls.

A plurality of bolts are used for the fastening to the steel frames. When the bolts are fastened up one by one until the bolt chip is sheared, a problem such that the bolts cannot be uniformly fastened arises. Therefore, in a normal manner, the bolts 21 should be primarily fastened by a constant torque weaker than the torque for shearing the bolt chip, and then should be finally fastened until the front end chip 23 is sheared.

Conventionally, a fastener for primary fastening only which automatically stops when a primary fastening torque is attained and a fastener for final fastening only which fastens the bolts until the bolt chip 23 is sheared should be used properly. This causes inconvenience and high cost in the screw fastening.

Also in the normal bolt/nut fastening, when the threads of the nuts and/or bolts are damaged, a current pattern similar to that at "E" to "I" in FIG. 11 appears. That is to say, when the threads of the nuts and/or bolts are normal, the current value exceeds "H" in FIG. 11 and continues to rise. The current value, however, occasionally falls abruptly after "H". This is because at the stages of fastening the nuts and/or bolts, the fastening torque is lost and the load of the motor sharply reduces. It can be, therefore, determined that the threads of the nuts and/or bolts have some sort of defect. In this case, it is necessary to send an alert to a worker of the fastening.

In order to solve the above problems, the present invention discloses an electric faster which performs a suitable control in the follow manner. In the case of the one-side bolts having shear washer, the shearing of the shear washer is detected on the basis of the pattern of the current value at a process of fastening the bolts and nuts. Further, in the case of the normal bolts and nuts, faulty fastening due to a defect or the like of the threads during the fastening is detected on the basis of the pattern of the current value. In the former case, when the current value rises to a value corresponding to the primary fastening torque after the shear washer is sheared, the electric fastener is automatically stopped. In the latter case, when the faulty fastening is detected, an alert is sent immediately.

Further, the present invention discloses an electric fastener which solves the following problem and can give a correct control command. The abrupt rise in the current value even with no load at the moment when the motor of the electric fastener is switched ON cannot be discriminated from the current value at the time of shearing the shear washer or the current value at the time of attaining the primary fastening torque.

SUMMARY OF THE INVENTION

An electric bolt/nut fastener according to the present invention includes: an inner socket which is engaged with a chip at a front end of a bolt; an outer socket which is engaged with a nut screwed to the bolt; a motor which is connected to both the sockets via a reduction mechanism which is capable of applying a rotating force in directions such that both the sockets are rotated oppositely; and a controller which controls the rotation of the motor. The controller has a first rise detecting unit which detects a rush current as an abrupt rise in a current value of the motor at the time when an starting switch is turned ON, and a first fall detecting unit which detects an abrupt fall and convergence of the current value immediately after the first rise detecting unit detects the abrupt rise in the current value. The controller determines that, when the first fall detecting unit detects the abrupt fall and the convergence of the current value, rising of the rush current is ended, and discriminates the abrupt rise in the current value at the time when the starting switch is turned ON from a rise in the current value at the time of bolt/nut fastening to be generated later.

The controller further includes a second fall detecting unit which detects that the current value abruptly falls after the current value rises due to the nut fastening, after the first fall detecting units detects the abrupt and convergence of the current value. When the second fall detecting unit detects the abrupt fall in the current value, the controller determines that an inward flange of the shear washer is sheared.

Further, after determining that the inward flange of the shear washer is sheared, the controller stops the motor when the current value reaches a current value corresponding to a preset primary fastening torque.

In the electric bolt/nut fastener according to the present invention, since the controller recognizes the rush current at the time of actuating the motor on the basis of the electric current pattern and generation timing, erroneous recognition does not occur. Therefore, a control can be performed properly in such a manner that the electric fastener at the time of ending the bolt/nut fastening is automatically stopped and an alert against an unexpected situation is sent after the rush current.

After the rush current at the time of actuating the motor converges and then the current value rises due to the fastening of the nut, the abrupt fall in the current value is detected. In this case, the abrupt fall is determined as the shearing of the shear washer. Therefore, the abrupt fall in the electric current immediately after the abrupt rise in the electric current at the time of actuating the motor is not determined as the shearing of the shear washer.

After the controller determines that the shear washer is sheared, when the current value of the motor reaches a value corresponding to the primary fastening torque, it stops the motor. As a result, the bolt and nut can be fastened by the primary fastening torque.

After the necessary number of the bolts and nuts are primarily fastened and are fastened up by the electric fastener which carried out the primary fastening, since the inward flange of the shear washer has been already sheared, the torque of the motor rises until the bolt chip is sheared, so that the bolt chip is sheared.

That is to say, if the electric fastener can output the torque which enables the fastening, the primary fastening and the final fastening can be performed by one electric fastener.

DESCRIPTION OF THE PREFERRED EMBODIMENTS

First Embodiment

[Electric Fastener for One-Side Bolt]

Figure 6:
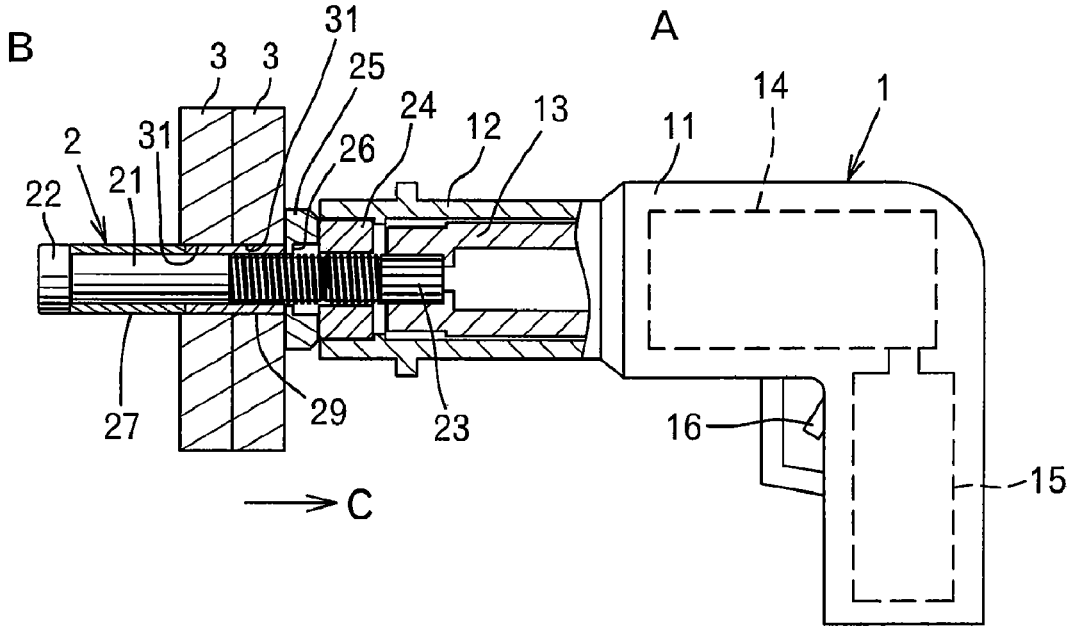
FIG. 6 is an explanatory diagram illustrating a one-side bolt and the electric fastener.
Figure 7:
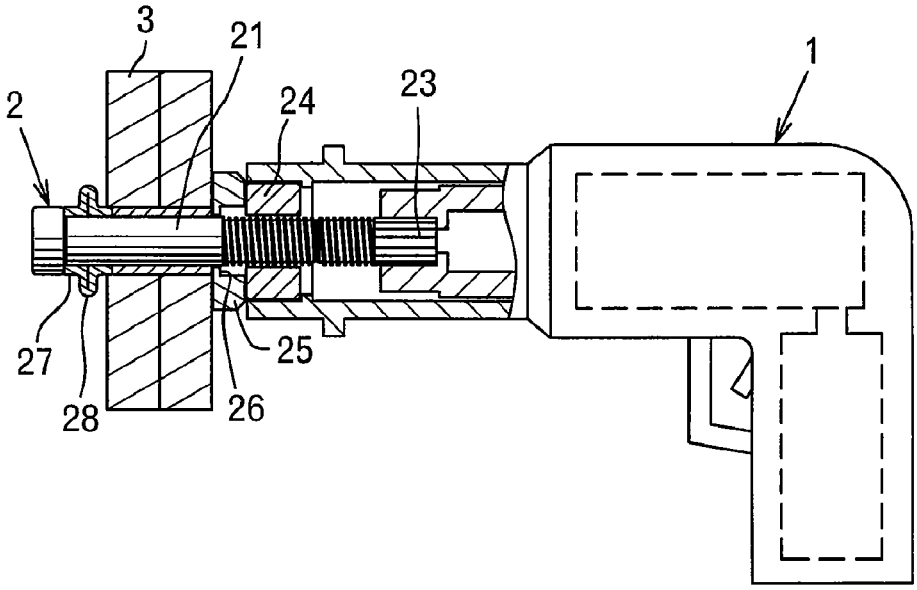
FIG. 7 is an explanatory diagram illustrating a state where a collar portion is formed on the one-side bolt.
Figure 8:
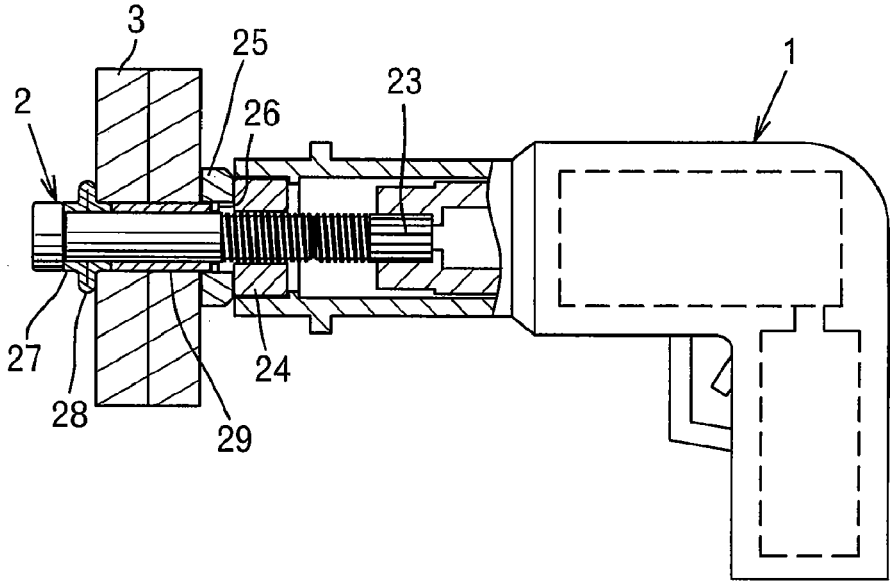
FIG. 8 is an explanatory diagram illustrating a state where a shear washer of the one-side bolt is sheared.
Figure 9:
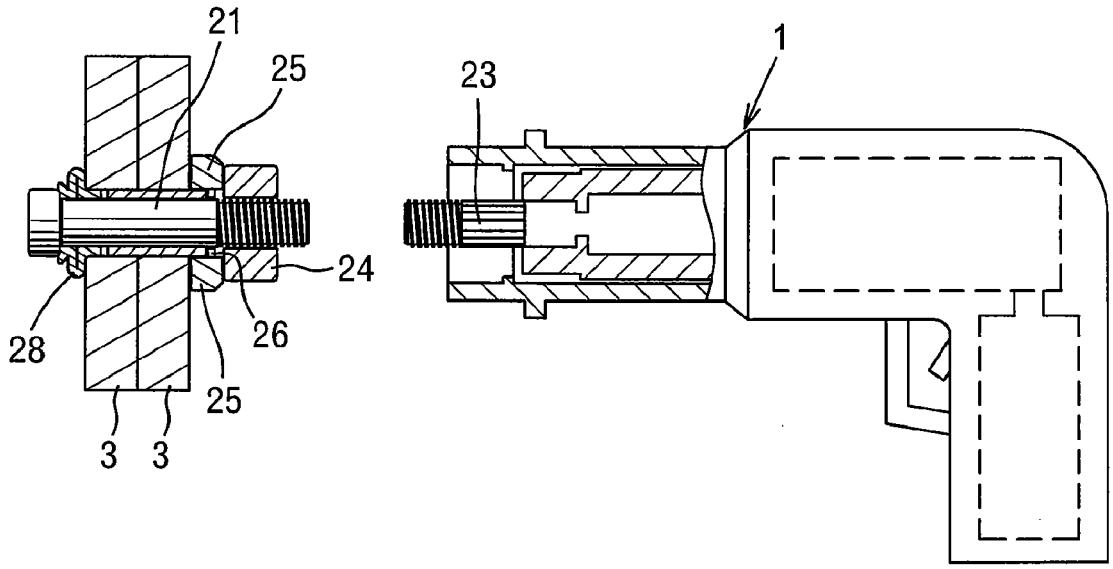
FIG. 9 is an explanatory diagram illustrating a state where a bolt chip of the one-side bolt is sheared.

Basic constitutions of both a one-side bolt 2 and an electric fastener 1 are the same as those of the conventional example shown in FIG. 6. A control system of the electric fastener 1 is different from conventional one.

Figure 1:
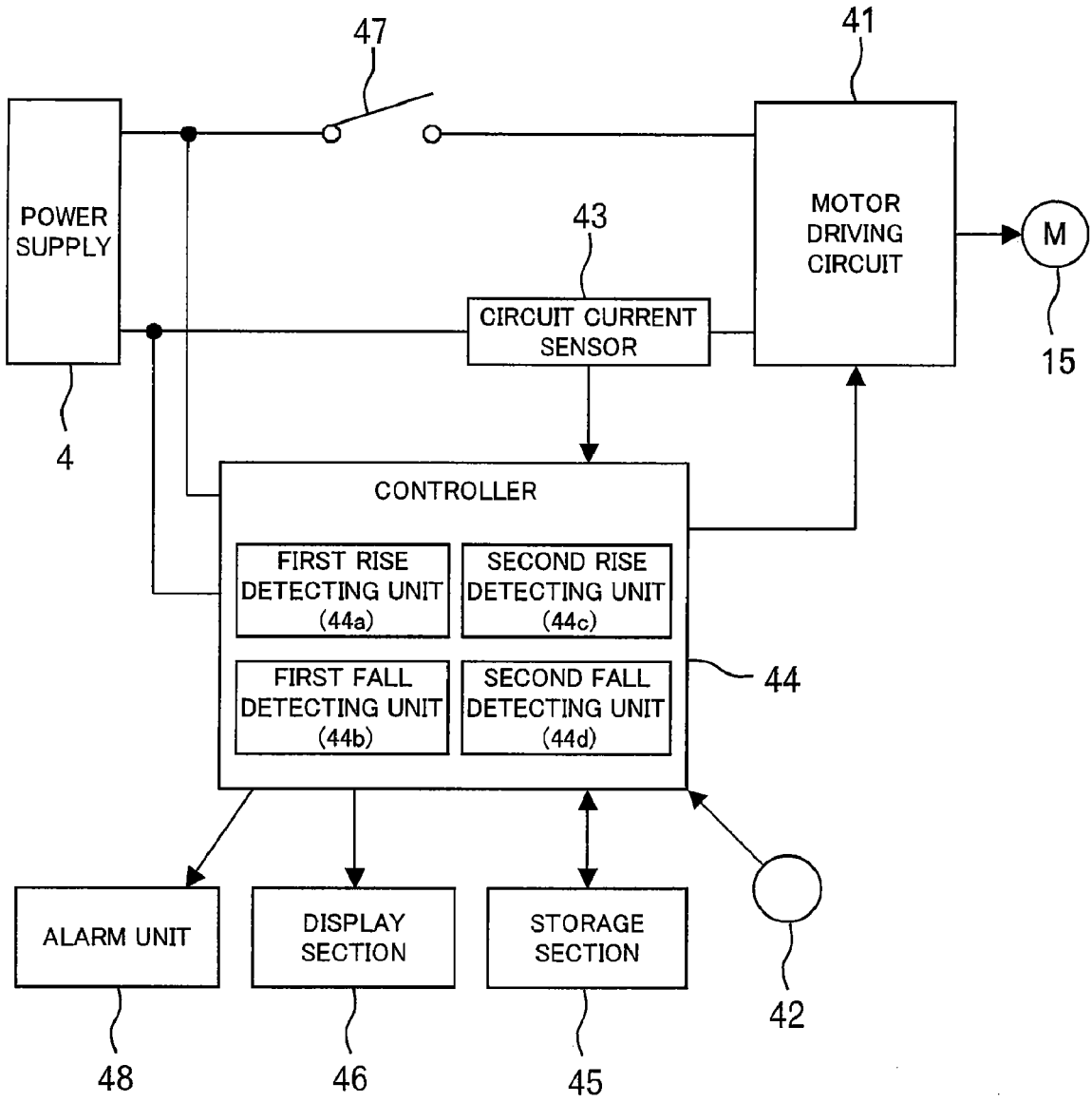
FIG. 1 is a control block diagram illustrating an electric bolt/nut fastener according to the present invention.

FIG. 1 is a block diagram illustrating the control system of the electric fastener in this embodiment.

A controller 44 controls electric connection of a driving motor 15 of the electric fastener between ON and OFF states via a motor driving circuit 41.

A circuit current sensor 43 which detects a current value is provided between a power supply 4 and the motor driving circuit 41. A signal from the circuit current sensor 43 is inputted into the controller 44, and the controller 44 receives the signal from the circuit current sensor 43 to control the motor driving circuit 41.

The controller 44 is connected to a torque setting dial 42 which is used by a worker for manually setting a primary fastening torque.

The controller 44 detects abrupt rise and abrupt fall just after the abrupt rise caused immediately after a trigger 16 of the electric fastener 1 is pulled and an starting switch 47 is turned ON. When the current value converges, the controller 44 determines that this specific current pattern is a change due to a rush current at the time of actuating the motor.

The controller 44 has a first rise detecting unit 44*a*, a first fall detecting unit 44*b*, a second rise detecting unit 44*c* and a second fall detecting unit 44*d* to be described later.

After detecting the rush current, when the controller 44 detects the abrupt fall in the current value after the rise in the current value, the controller 44 determines this as the abrupt rise in the current value due to the starting of the nut fastening and the abrupt fall in the current value due to the shearing of the shear washer 25 of the one-side bolt 2. After this determination, when the current value reaches a value corresponding to the primary fastening torque, the controller 44 stops the motor.

The controller 44 is connected to a storage section 45 as a memory in which thresholds of the electric current that will be described later, are stored and a display section 46 including a group of various lamps. Specifically, the lamp group includes "an operation lamp" which shows that the motor 15 is rotating, "an on-fastening lamp" which shows that the nut 24 is started to be fastened, "a washer shearing lamps" which shows that the shear washer 25 is sheared, and "a primary fastening end lamp" which shows that the primary fastening of the nut 24 is ended.

The electric fastener 1 is connected also to an alarm unit 48 such as an alarm buzzer or an alarm lamp, and in the case of faulty fastening to be described later, the alarm unit 48 sends an alert.

Figure 10:
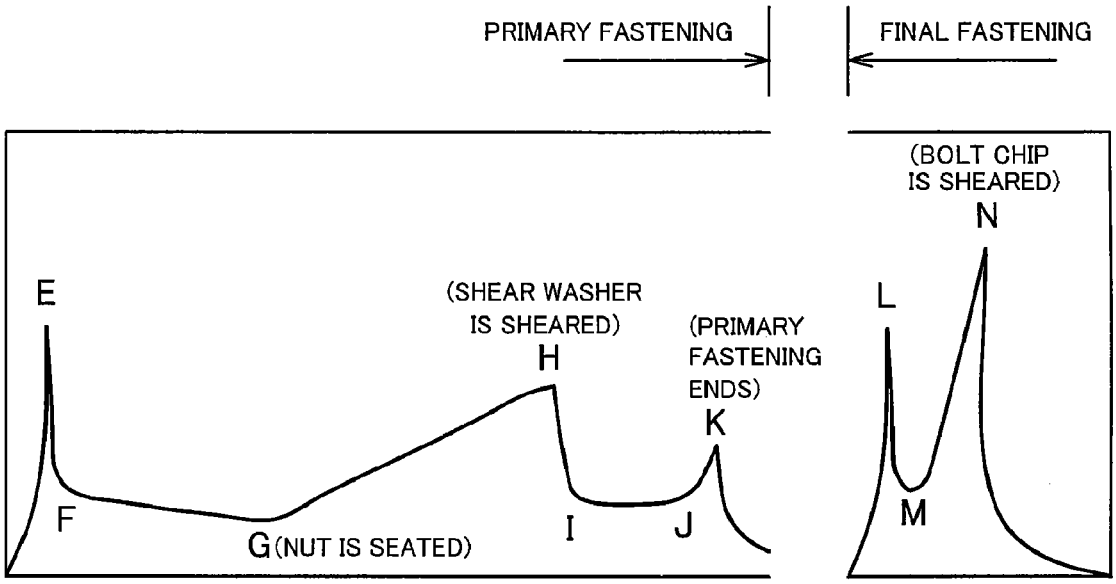
FIG. 10 is an electric current pattern chart when the one-side bolt is fastened by the electric fastener according to the present invention.

As shown in FIG. 6, in the case where the one-side bolt 2 which is set on the steel frames 3 is fastened by the electric fastener 1, FIG. 10 is a graph showing a change in the current value at the time of carrying out the normal primary fastening and final fastening in which the current value detected by the circuit current sensor 43 is plotted along the vertical axis and elapsed time is plotted along the horizontal axis.

Figure 11:
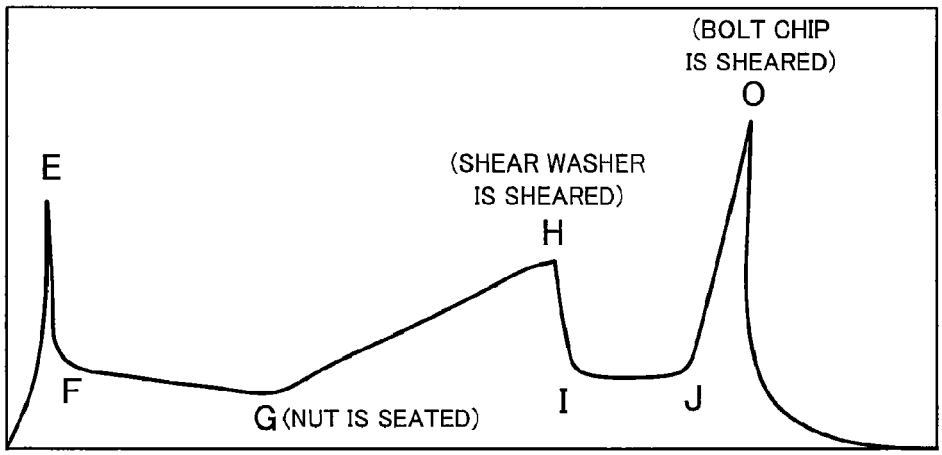
FIG. 11 is an electric current pattern chart when the one-side bolt is fastened by a conventional electric fastener.

When the trigger 16 is pulled, the switch 47 is turned ON and the motor 15 is actuated. As shown from "E" to "F" in FIG. 10 (similar to "E" to "F" described in the conventional example in FIG. 11), the current value pattern of the rush current is formed.

The nut 24 is seated, the tube member for collar 27 of the one-side bolts 2 is started to be plastically deformed, and a load is applied to the motor 15. As shown between "GP" to "H" in FIG. 10, the current value becomes gradually larger.

At "H", the shear washer 25 is sheared, the current value abruptly falls and converges to a lower value (between "H" and "I").

When the nut 24 is rotated, the fastening to the steel frames 3 is started, and the current value becomes gradually larger (between "J" and "K").

When the current value reaches the preset value corresponding to the primary fastening torque, the electric connection to the motor 15 is cut off by means of a signal from the controller 44.

Therefore, the one-side bolt 2 is not fastened by a torque which is stronger than the primary fastening torque.

When the primary fastening of the necessary number of the one-side bolts 2 is completed, the final fastening is carried out until the chip 23 of the shear bolt 21 is broken. The final fastening can be carried out by the electric fastener 1 which carried out the primary fastening if it can provide an enough maximum output torque.

When the trigger 16 is pulled and the switch 47 of the electric fastener 1 is turned ON to actuate the motor 15, the rush current pattern is formed as shown between "L" and "M" in FIG. 10.

Thereafter, the nut 24 is fastened. Since the nut is primarily fastened, the load is applied abruptly, so that the current value becomes large abruptly as shown between "M" and "N".

When the nut 24 is fastened up completely, the rotation of the outer socket 12 is stopped, and the inner socket 13 rotates in a direction opposite to the outer socket 12, so that the chip 23 at the front end of the shear bolt 21 is sheared. "N" in FIG. 10 indicates the current value at the time of the chip shearing.

Figure 2:
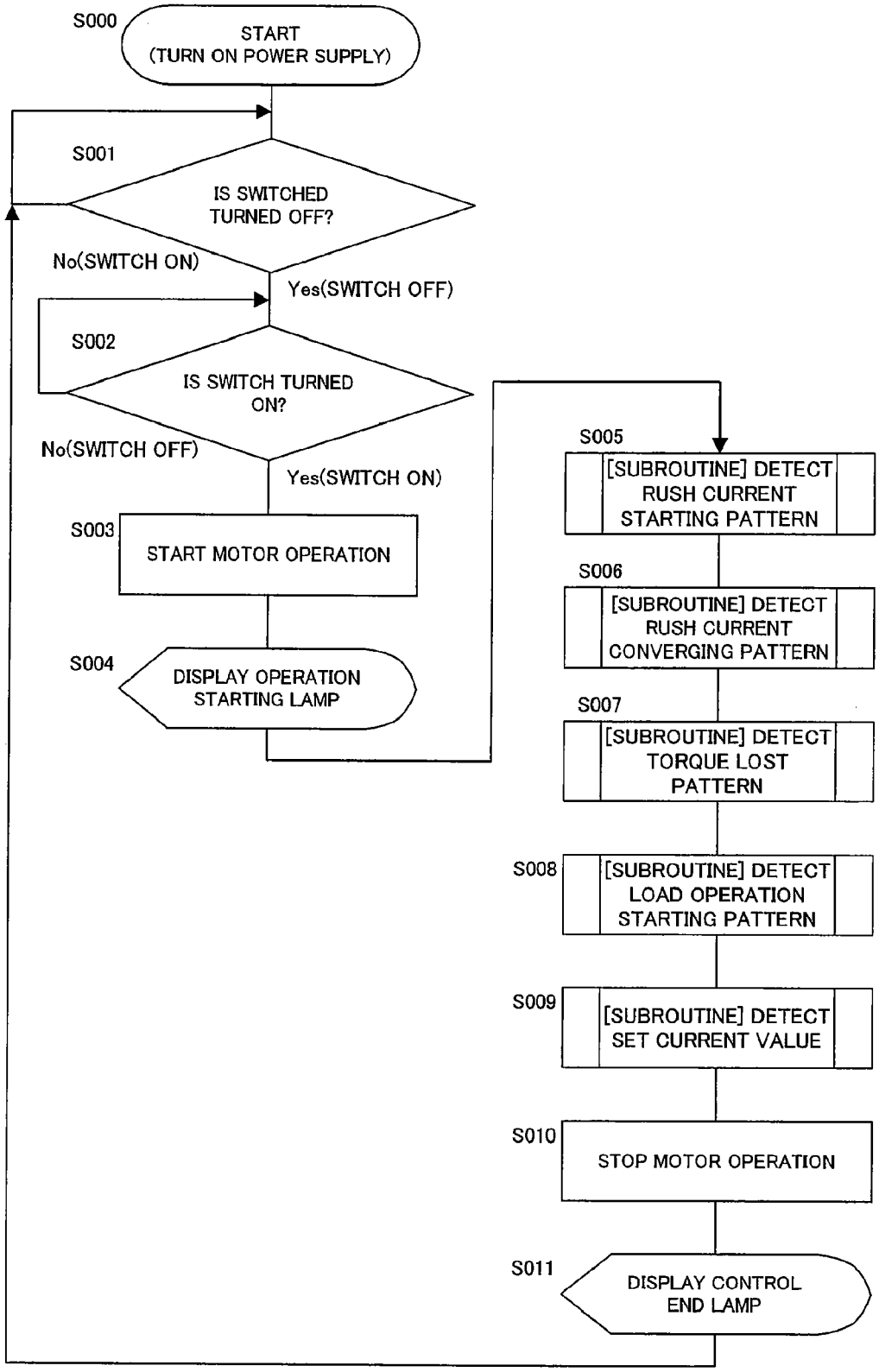
FIG. 2 is a control flowchart of the electric bolt/nut fastener according to the present invention.

FIG. 2 is a control flowchart of the primary fastening.

A power supply plug (not shown) of the electric fastener 1 is inserted into a socket, so that the electric fastener 1 is powered ON (S000). At this time, in a state where the trigger 16 of the electric fastener 1 is being pulled, namely, the power supply switch 47 is ON, a motor driving command is not given to the motor driving circuit 41 (S001). When the trigger 16 is released and the power supply switch 47 is OFF, the sequence goes on to S002. When the trigger 16 is pulled and the power supply switch 47 is turned ON at this time, the motor driving command is given to the motor driving circuit 41 (S003), and an operation lamp lights on (S004). The first rise detecting unit 44*a* performs an operation on the basis of a rush current starting pattern detecting subroutine (S005) to be described later, and detects a current value pattern of the rush current generated immediately after the electric faster is electrically connected to the motor 15.

The first fall detecting unit 44*b* performs an operation on the basis of a rush current converging pattern detecting subroutine (S006) to be described later, and detects that the rush current converges.

When the bolt chip and the nut are set in the inner socket and the outer socket of the fastener properly, the bolt and nut are fastened as mentioned above, and after the nut 24 is seated, the fastening to the steel frames 3 is started. The shearing of the shear washer 25 is detected at a torque lost pattern detecting subroutine (S007) to be described later.

At a set current value detecting subroutine (S009) to be described later, when the fastening torque for the bolt and nut reaches a fastening torque for the bolt and nut set by the torque setting dial 42, the rotation of the motor 15 is stopped (S010). The end of the control is displayed by means of the "primary fastening end lamp" (S011), and the sequence returns to S001 so that the electric fastener 1 prepares for the next primary fastening of bolt and nut.

Figure 3:
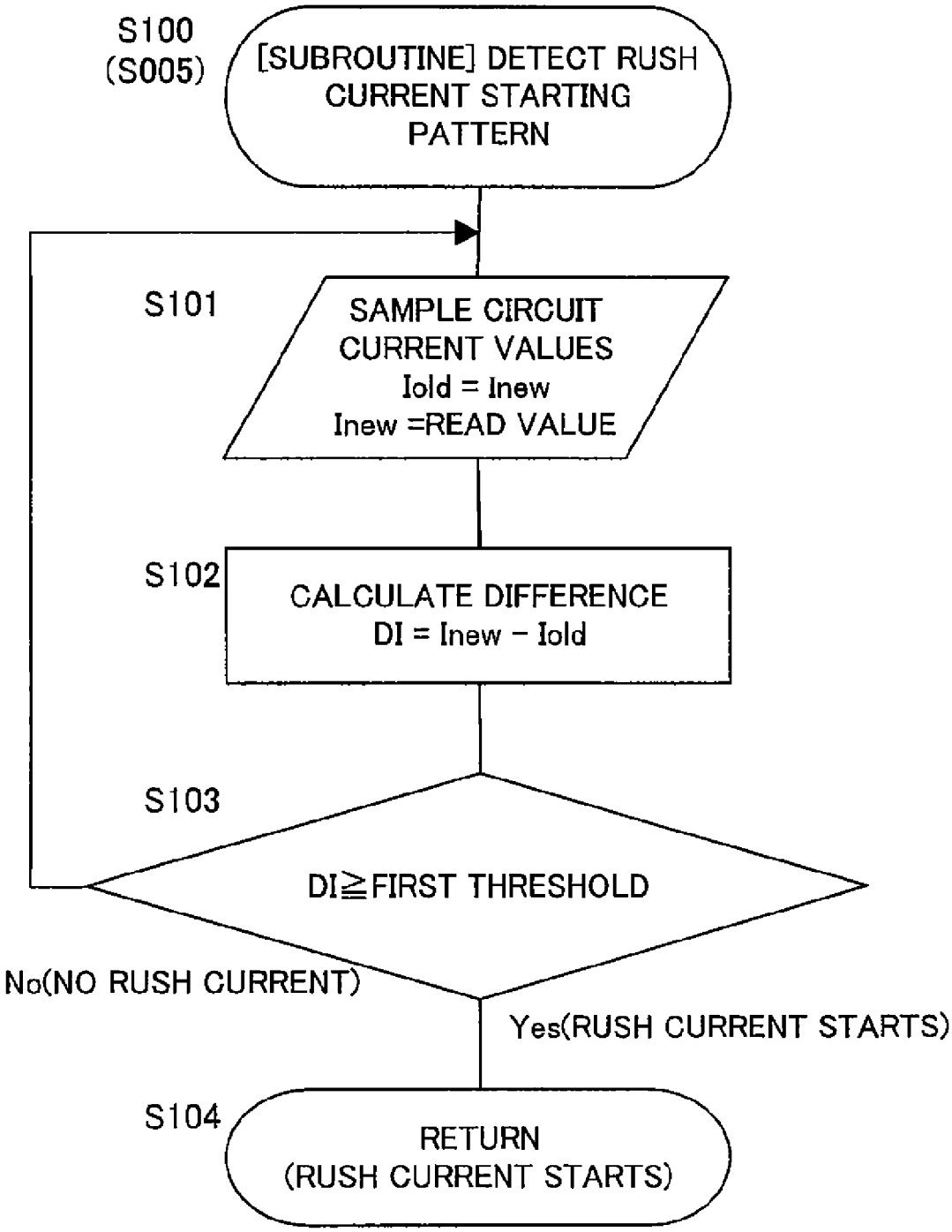
FIG. 3 is a flowchart of a subroutine for rush current starting pattern detecting.

FIG. 3 illustrates the rush current starting pattern detecting subroutine (S005).

At the subroutine (S100), the controller 44 samples the current values (S101), calculates a difference in the current differential values (S102), and compares the difference with a first threshold stored in the storage section 45 (S103). In the calculation of the difference in the differential values, A difference between read value of current which was sampled per unit of time and the previous stored read value is obtained.

When the result of the difference calculation becomes larger than the first threshold, the controller 44 determines this state as the rush current start. Thereafter, the first fall detecting unit 44*b* performs an operation on the basis of the rush current converging pattern detecting subroutine (S006) in FIG. 2 and detects the rush current converging pattern.

At the following respective subroutines, the calculation of the difference in the differential values adopts the above method.

Figure 4:
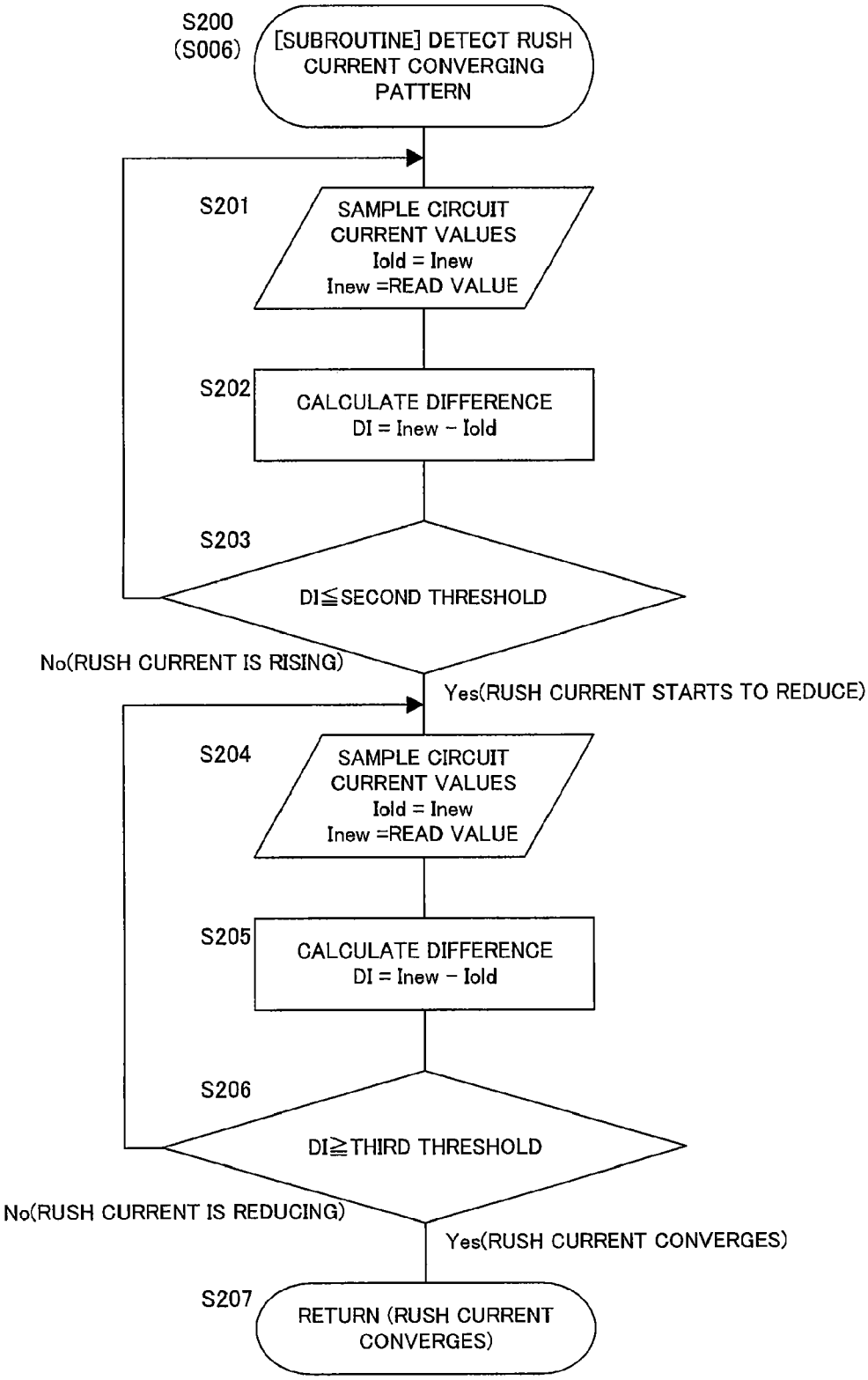
FIG. 4 is a flowchart of a subroutine for rush current converging pattern detecting.

FIG. 4 illustrates the rush current converging pattern detecting subroutine (S006) to be executed by the first fall detecting unit 44*b*.

At a subroutine S200, the controller 44 samples the current values (S201), calculates the difference in differential values (S202), and compares the difference with a second threshold stored in the storage section 45 (S203).

When the result of the difference calculation is smaller than the second threshold, the controller 44 determines this state as rush current reduction start, and the sequence goes on to S204. The controller 44 samples the current values, and calculates the difference in the current differential values (S205). When the result of the difference calculation becomes larger than a third threshold, the controller 44 determines this state as rush current convergence (S206).

Figure 5:
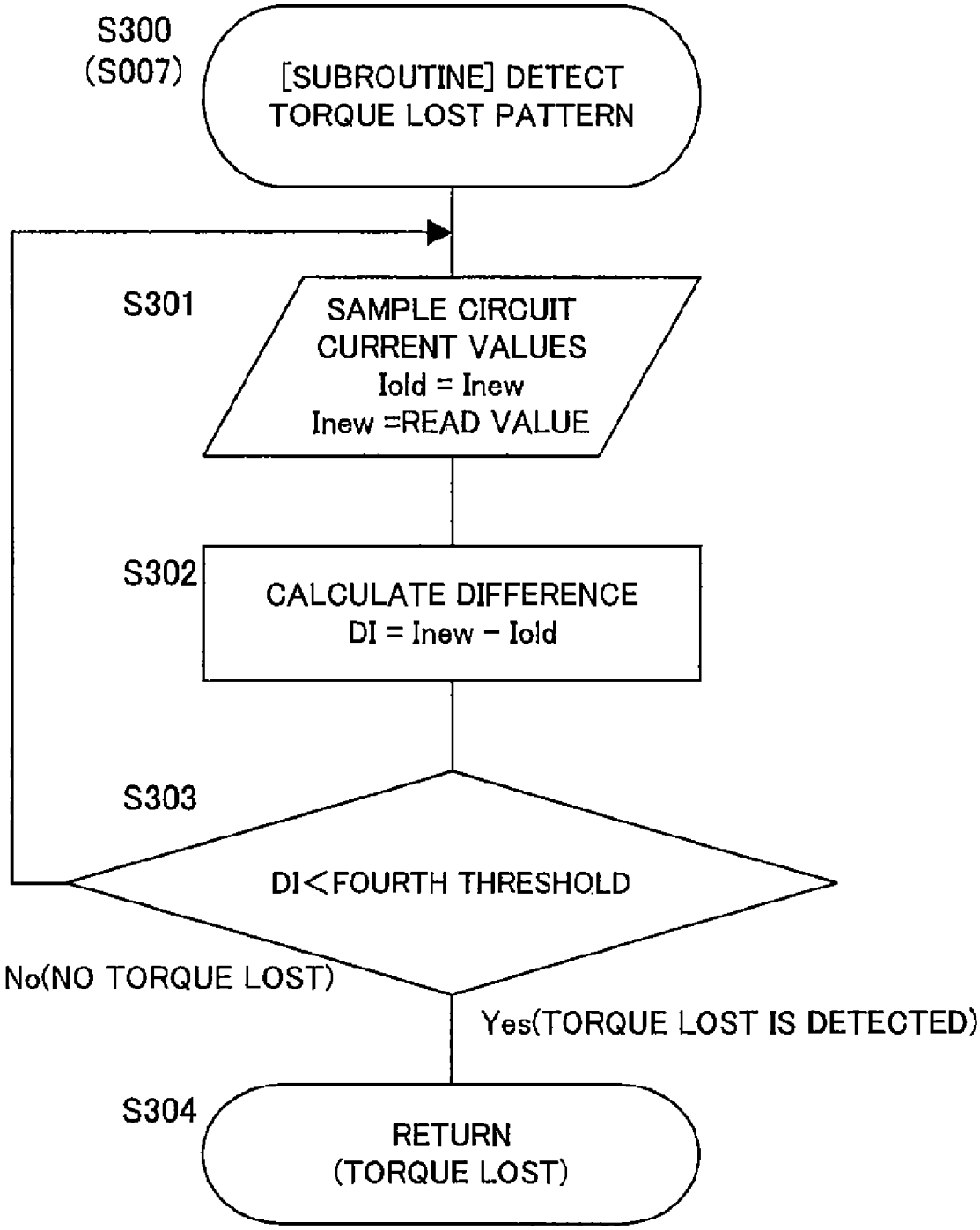
FIG. 5 is a flowchart of a subroutine for torque lost pattern detecting.

FIG. 5 illustrates the torque lost pattern detecting subroutine (S007) to be executed by the second fall detecting unit.

At the torque lost pattern detecting subroutine S300, the controller 44 samples the current values (S301), and calculates the difference in the current differential values (S302). When the result of the difference calculation becomes smaller than a fourth threshold, the controller 44 determines this state as torque lost, namely, the sheared state of the shear washer 25 (S303). The controller 44 detects a load operation starting pattern on the basis of a load operation starting pattern detecting subroutine (S008) of FIG. 2.

At the load operation starting pattern detecting subroutine (S008) (the details are not illustrated), the controller 44 samples the current values, calculates the difference in the differential values, and compares the difference with a fifth threshold stored in the storage section 45.

When the result of the difference calculation is larger than the fifth threshold, the controller 44 determines this state as the load operation start (start of the fastening to the steel frames) and performs an operation on the basis of a set current detecting subroutine of FIG. 2.

At the set current detecting subroutine (S009) (the details are not shown), the controller 44 samples the current values, and compares the difference with a sixth threshold stored in the storage section 45.

When the result of sampled current value is larger than the sixth threshold, the controller 44 determines this state as set current value detection, namely, the end of the primary fastening. The sequence, then, goes to S010 of FIG. 2, and the controller 44 cuts off the electric connection to the motor 15. The sequence further goes on to S011, the controller 44 turns "the primary fastening end lamp" ON.

When the primary fastening for the predetermined number of the one-side bolts 2 is ended, the final fastening is carried out.

The electric fastener 1 which was used for the primary fastening can carry out the final fastening if it can output a torque necessary for the final fastening.

The current value at this time is shown on the right end of FIG. 10.

At S000 to S006 in FIG. 2, the final fastening proceeds similarly to the primary fastening, and thereafter when the final fastening is started, the fastening is carried out until the bolt chip is sheared.

"L" in FIG. 10 indicates an upper end of the rush current value at the time of the final fastening, and "M" indicates the convergence. "N" indicates the point of time when the bolt chip 23 is sheared by the final fastening.

In this embodiment, when the rise in the current value from the seating of the nut 24 at "G" to the shearing of the shear washer 25 at "H" in FIG. 10 is too gentle, the shear bolt 21 and/or the nut 24 are/is abnormally fastened due to damaged threads, and it is not ensured that they are fastened by a necessary fastening torque. It is, therefore, desirable that an alert is sent even during the fastening and the motor 15 is stopped.

In this embodiment, when the time required for the seating of the nut 24 through the shearing of the shear washer 25 exceeds a preset time, the controller 44 determines that the rise in the current value is too gentle, and operates the alarm unit 48 and cuts off the electric connection to the motor 15.

In the above description, optimum thresholds may be selected through experiments or the like according to conditions such as the ability of the fastener and diameters of the bolts and nuts as the first to sixth thresholds. For example, in the present embodiment, the first threshold is 20 A (ampere) per sample time.

The above describes the fastening of the one-side bolt 2, but the fastener 1 can be used not only for the one-side bolt 2 but also for bolts and nuts having the chip 23 at their front ends.

In this case, an abrupt torque lost due to unusual circumstances such as faulty shearing of threads due to defective threads can be detected during the fastening of bolts and nuts on the basis of the functions up to S007 in the flowchart shown in FIG. 2.

That is to say, the shearing of the shear washer at "H" in FIG. 10 corresponds to the unusual circumstance, and when the current value abruptly falls, the unusual circumstances can be recognized.

However, it should be noted that when the chip 23 at the front end is for shearing and the processes from the first fastening through the shearing of the chip 23 at the front end are executed at a time without conducting the primary fastening, the shearing of the chip is determined as the unusual circumstance.

Second Embodiment

The electric fastener 1 in the first embodiment has the outer socket 12 and the inner socket 13, and is dedicated to bolts and nuts having the chip 23 which is engaged with the inner socket 13 at the front end of the bolt. The electric fastener 1 in the second embodiment shown in FIG. 12 is applied to a normal electric bolt/nut fastener which does not have a chip at a front end of the bolt.

Figure 12:
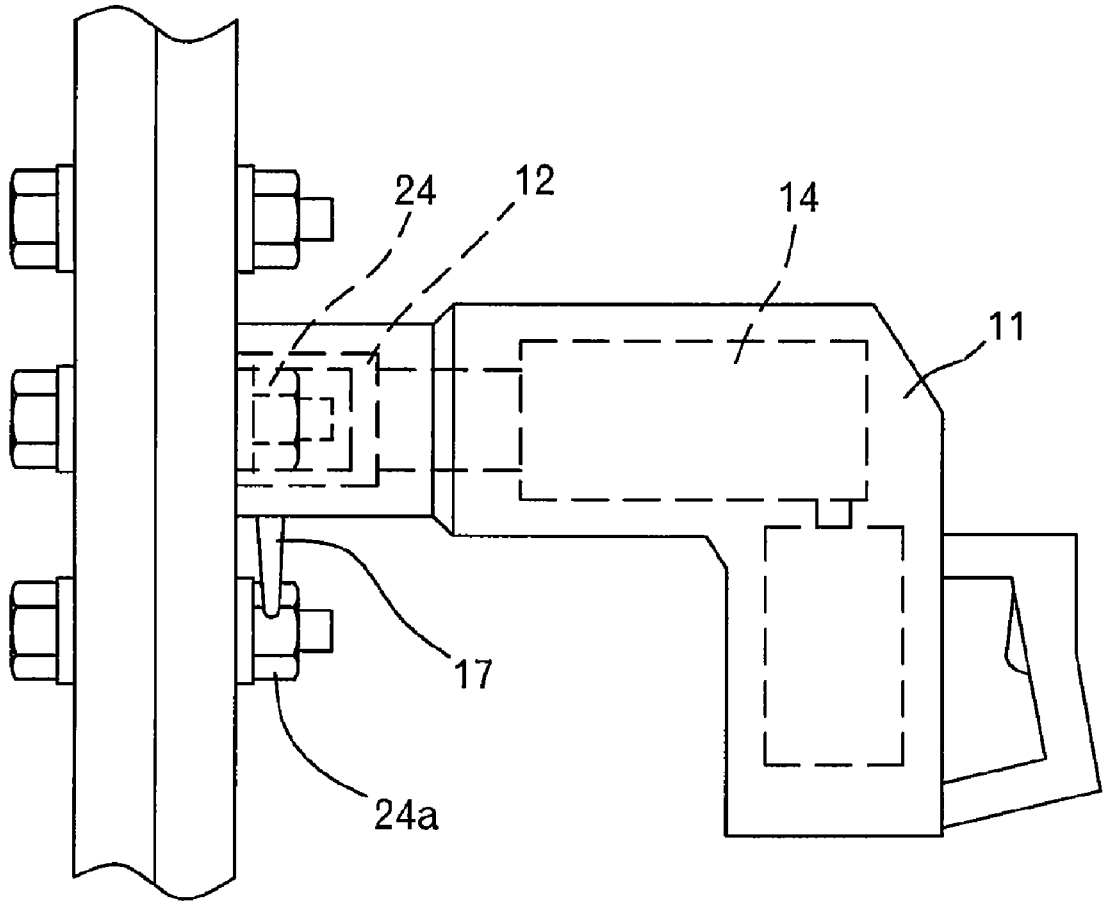
FIG. 12 is an explanatory diagram illustrating the electric fastener according to a second embodiment of the present invention.

In the electric fastener 1 in the second embodiment, as shown in FIG. 12, the casing 11 houses a planetary gear reduction mechanism 14 having one input shaft and two output shafts. One output shaft of the planetary gear reduction mechanism 14 is connected to the socket 12 which rotatably protrudes from the front end of the casing, and the reactive force receiver 17 connected to the other output shaft is perpendicular to a shaft center of the socket 12 or protrudes therefrom obliquely.

The nut 24 is engaged with the socket 12, and the reactive force receiver 17 is brought into contact with a protrusion such as another nut 24*a* in the vicinity of the nut, so that the nut 24 is fastened.

In the normal bolt/nut fastening, the patterns of the current values from the turning-on of the power supply to the end of the primary fastening and the end of the final fastening are similar to those of FIG. 10. The point "H" in FIG. 10 is determined as the torque lost due to defective threads.

The controller 44 is provided with the second rise detecting unit 44*c* which detects a rise in the current value after the first fall detecting unit 44*b* detects the abrupt fall and the convergence of the current value. When the second rise detecting unit 44*c* detects the current value corresponding to the preset fastening torque, the rotation of the motor may be stopped.

What is claimed is:

1. An electric bolt/nut fastener, comprising:

an inner socket which is engaged with a chip at a front end of a bolt;

an outer socket which is engaged with a nut screwed to the bolt;

a motor which is connected to both the sockets via a reduction mechanism which is capable of applying a rotating force in directions such that both the sockets are rotated oppositely; and a controller which controls the rotation of the motor, wherein the controller has a first rise detecting unit which detects a rush current as an abrupt rise in a current value of the motor at the time when a starting switch is turned ON, and a first fall detecting unit which detects abrupt fall and convergence of the current value immediately after the first rise detecting unit detects the abrupt rise in the current value, and the controller determines that, when the first fall detecting unit detects the abrupt fall and the convergence of the current value, rising of the rush current is ended, and discriminates the abrupt rise in the current value at the time when the starting switch is turned ON from a rise in the current value at the time of bolt/nut fastening to be generated later.

2. The electric bolt/nut fastener according to claim 1, wherein the controller has a second rise detecting unit which detects a rise in the current value after the first fall detecting unit detects the abrupt fall and convergence of the current value, and when the second rise detecting unit detects the current value corresponding to a preset fastening torque, the second rise detecting unit stops the rotation of the motor.

3. An electric bolt/nut fastener, comprising:

a socket which is engaged with a nut and a reactive force receiver which receives a reactive force with respect to a rotating direction of the socket;

a motor which is connected to the socket and the reactive force receiver via a reduction mechanism which is capable of applying a rotating force in directions such that they rotate oppositely; and a controller which controls the rotation of the motor, wherein the controller has a first rise detecting unit which detects a rush current as an abrupt rise in a current value of the motor at the time when a starting switch is turned ON, and a first fall detecting unit which detects that the current value abruptly falls and converges immediately after the first rise detecting unit detects the abrupt rise in the current value, and the controller determines that, when the first fall detecting unit detects the abrupt fall and the convergence of the current value, rising of the rush current is ended, and discriminates the abrupt rise in the current value at the time when the starting switch is turned ON from a rise in the current value at the time of bolt/nut fastening to be generated later.

4. The electric bolt/nut fastener according to claim 3, wherein the controller has a second rise detecting unit which detects a rise in the current value after the first fall detecting unit detects the abrupt fall and convergence of the current value, and when the second rise detecting unit detects the current value corresponding to a preset fastening torque, the second rise detecting unit stops the rotation of the motor.

5. An electric bolt/nut fastener, comprising:

an outer socket which is engaged with a nut screwed to a one-side bolt having a shear washer;

an inner socket which is engaged with a chip at a front end of the one-side bolt;

a motor which is connected to both the sockets via a reduction mechanism which is capable of applying rotating forces in the directions opposite to each other to the sockets, respectively; and a controller which controls the rotation of the motor, wherein the controller has a first rise detecting unit which detects a rush current as an abrupt rise in a current value of the motor at the time when a starting switch is turned ON, and a first fall detecting unit which detects that the current value abruptly falls and converges immediately after the first rise detecting unit detects the abrupt rise in the current value, and the controller determines that, when the first fall detecting unit detects the abrupt fall and convergence of the current value, rising of the rush current is ended, and discriminates the abrupt rise in the current value at the time when the starting switch is turned ON from a rise in the current value at the time of bolt/nut fastening to be generated later.

6. The electric bolt/nut fastener according to claim 5, wherein the controller has a second fall detecting unit which, after the first fall detecting unit detects the abrupt fall and convergence of the current value, detects that the current value abruptly falls after the current value rises due to the nut fastening, and when the second fall detecting unit detects the abrupt fall in the current value, the controller determines that an inward flange of the shear washer is sheared.

7. The electric bolt/nut fastener according to claim 6, wherein after determining that the inward flange of the shear washer is sheared, the controller stops the motor when the current value reaches a current value corresponding to a preset primary fastening torque.

8. The electric bolt/nut fastener according to claim 5, wherein after determining that the inward flange of the shear washer is sheared, the controller stops the motor when the current value reaches a current value corresponding to a preset primary fastening torque.

* * * * *